US010189248B2

(12) United States Patent
Fricke et al.

(10) Patent No.: US 10,189,248 B2
(45) Date of Patent: Jan. 29, 2019

(54) PRINTHEAD WITH MICROELECTROMECHANICAL DIE AND APPLICATION SPECIFIC INTEGRATED CIRCUIT

(71) Applicant: HEWLETT-PACKARD DEVELOPMENT COMPANY, L.P., Houston, TX (US)

(72) Inventors: Peter James Fricke, Corvallis, OR (US); Andrew L. Van Brocklin, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/518,299

(22) PCT Filed: Oct. 28, 2014

(86) PCT No.: PCT/US2014/062667
§ 371 (c)(1),
(2) Date: Apr. 11, 2017

(87) PCT Pub. No.: WO2016/068884
PCT Pub. Date: May 6, 2016

(65) Prior Publication Data

US 2017/0313058 A1 Nov. 2, 2017

(51) Int. Cl.

| | |
|---|---|
| ***B41J 2/045*** | (2006.01) |
| ***B41J 2/175*** | (2006.01) |
| ***B41J 2/14*** | (2006.01) |

(52) U.S. Cl.
CPC ..... *B41J 2/04541* (2013.01); *B41J 2/04581* (2013.01); *B41J 2/14072* (2013.01); *B41J 2/14153* (2013.01); *B41J 2/17546* (2013.01)

(58) Field of Classification Search
CPC ..... B41J 2/21; B41J 2/04541; B41J 2/04581
See application file for complete search history.

(56) References Cited

U.S. PATENT DOCUMENTS

| | | | | |
|---|---|---|---|---|
| 6,357,863 | B1 | 3/2002 | Anderson et al. | |
| 6,984,012 | B2 * | 1/2006 | Asauchi | B41J 2/17546 347/19 |
| 8,425,004 | B2 * | 4/2013 | McAvoy | B41J 2/1433 347/44 |
| 2003/0063161 | A1 | 4/2003 | Dodd et al. | |
| 2006/0164455 | A1 | 7/2006 | Silverbrook et al. | |

(Continued)

FOREIGN PATENT DOCUMENTS

| | | |
|---|---|---|
| WO | WO-2012044299 | 4/2012 |
| WO | WO-2014084843 | 11/2012 |

(Continued)

*Primary Examiner* — Thinh H Nguyen
(74) *Attorney, Agent, or Firm* — HP Inc.—Patent Department

(57) ABSTRACT

A print head assembly (PHA) includes a microelectromechanical systems (MEMS) die mounted to a substrate with an application specific integrated circuit (ASIC). The die includes an opening defined in the die, a plurality of nozzles adjacent to the opening in fluid communication with the opening, and a pad to receive electrical control signals. The ASIC includes a communication link and a plurality of transmission lines that transmit electrical signals to the MEMS die.

19 Claims, 6 Drawing Sheets

(56) References Cited

U.S. PATENT DOCUMENTS

| | | | |
|---|---|---|---|
| 2007/0103501 | A1 | 5/2007 | Hatsui et al. |
| 2010/0271439 | A1 | 10/2010 | Sheahan et al. |
| 2011/0292126 | A1 | 12/2011 | Nystrom et al. |
| 2013/0155142 | A1 | 6/2013 | Browning et al. |
| 2013/0194349 | A1 | 8/2013 | Ciminelli et al. |
| 2014/0002546 | A1 | 1/2014 | Phillips et al. |
| 2018/0022093 | A1 | 1/2018 | Bibl et al. |

FOREIGN PATENT DOCUMENTS

| | | |
|---|---|---|
| WO | WO2013002775 | 1/2013 |
| WO | WO-2013002775 | 1/2013 |

* cited by examiner

PRINTHEAD WITH MICROELECTROMECHANICAL DIE AND APPLICATION SPECIFIC INTEGRATED CIRCUIT

BACKGROUND

A printhead contains a collection of jets for ejecting a fluid. Each jet includes a chamber with a nozzle. The chamber receives fluid from a fluid supply. When the jet is to be fired, meaning that a drop of fluid is to be ejected, there are different possible mechanisms for firing the jet. In some examples, a resistor heats, vaporizing a portion of the fluid in the chamber. This expels fluid from the nozzle to the target. Once the vapor bubble pushes the fluid from the nozzle, it draws more fluid into the chamber from the opening. Alternatively, a piezoelectric element may be actuated to fire the jet, expelling the fluid. The number of jets on a printhead have increased as the technology has advanced, allowing more control over the deposition pattern. Printheads and their components have continued to increase in complexity.

BRIEF DESCRIPTION OF THE DRAWINGS

The accompanying drawings illustrate various examples of the principles described herein and are a part of the specification. The illustrated examples do not limit the scope of the claims.

Throughout the drawings, identical reference numbers designate similar, but not necessarily identical, elements.

DETAILED DESCRIPTION

Printers, including thermal ink jet and piezoelectric ink jet printers have seen significant advances in dots per inch, complexity, and capabilities. However, the general advance of technology has pressed for increases in printer functionality to keep up with increasingly fast and complex computing systems.

The present specification describes a printhead for depositing fluid onto a surface. The printhead includes an application specific integrated circuit (ASIC) and a number of microelectromechanical systems (MEMS) dice. Each MEMS die includes a number of fluid jets. Each jet has a nozzle, a firing chamber to hold an amount of fluid, and, in a thermal inkjet printer a firing resistor to eject the amount of fluid through the nozzle. In a piezoelectric ink jet, a piezoelectric actuator element replaces the firing resistor to expel the fluid. A portion of the controls for the MEMS die is provided by the ASIC.

As used in the present specification and in the appended claims, the term "printer cartridge" may refer to a device used in the ejection of ink, or other fluid, onto a print medium. In general, a printer cartridge may be a fluidic ejection device that dispenses fluid such as ink, wax, polymers or other fluids. A printer cartridge may include a printhead. In some examples, a printhead may be used in printers, graphic plotters, copiers and facsimile machines. In these examples, a printhead may eject ink, or another fluid, onto a medium such as paper to form a desired image.

Still further, as used in the present specification and in the appended claims, the term "a number of" or similar language may include any positive number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described is included in at least that one example, but not necessarily in other examples.

Figure 1:
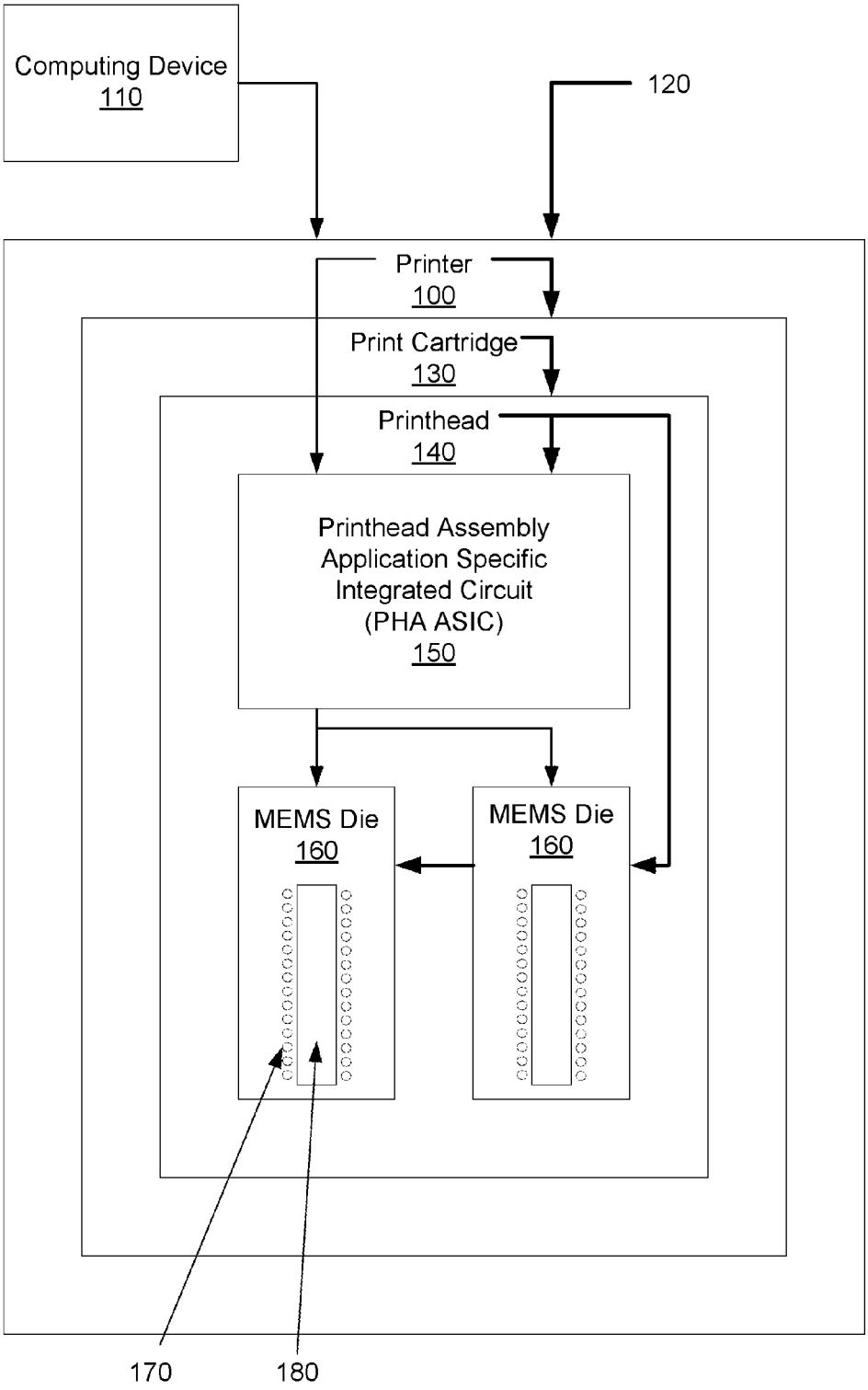
FIG. 1 is a diagram of a printer cartridge and printhead for depositing fluid onto a surface according to one example of the principles described herein.

Turning now to the figures, FIG. 1 is a general layout of a printer (100) with a printhead (140) according to one example of the principles described herein. The printer (100) receives power from a power supply (120). The printer (100) also receives information in the form of a print job to be printed from a computing device (110), also called a client.

The printer (100) provides power (120) to the printer cartridge (130) which in turn supplies power for the printhead (140). In some examples the printer provides power directly to the printhead (140). The printhead (140) includes a printhead assembly (PHA) application specific integrated circuit (ASIC) (150) and a plurality of MEMS dice (160). The printhead (140) provides power to the PHA ASIC (150) and the MEMS dice (160). The PHA ASIC (150) provides data to the MEMS dice (160) to control the firing of the jets (170). The jets (170) are located near an opening (180) which provides fluid for the jets (170), as discussed in greater detail below.

Figure 2:
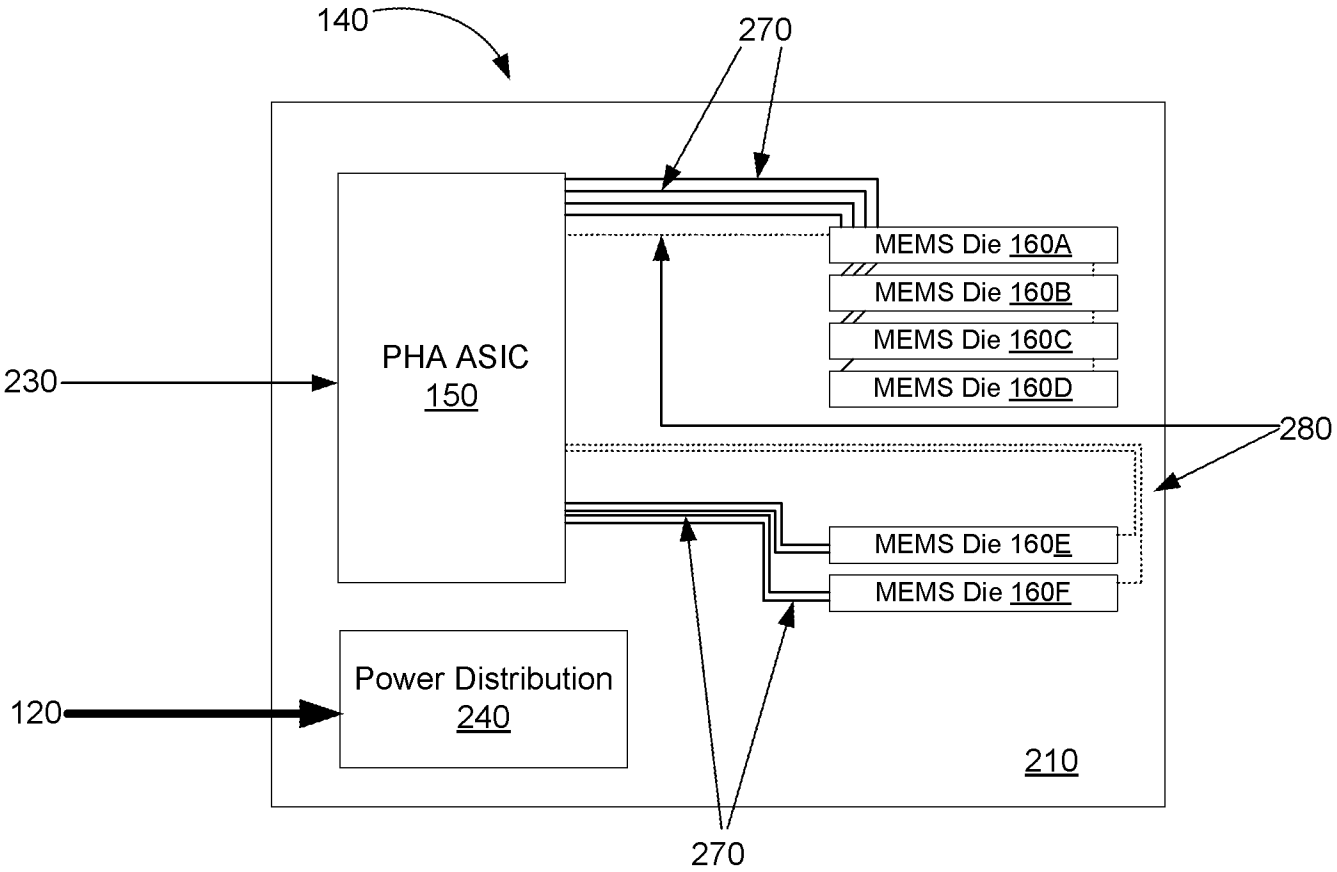
FIG. 2 is a diagram of a printhead for depositing fluid onto a surface according to one example of the principles described herein.

FIG. 2 is a diagram of a printhead assembly (140) for depositing fluid onto a surface according to one example of the principles described herein. The printhead assembly (140) is assembled on a substrate (210) which provides power distribution (240) and signal distribution to the mounted components. The substrate (210) may receive power from an off-board source (120). In other examples, the substrate (210) receives power from the printer cartridge (130). In another example, the substrate receives from the printer (100) as the power source (120).

Mounted on the substrate (210) are the PHA ASIC (150) and a plurality of MEMS dice (160A, 160B, 160C, 160D, 160E, 160F) collectively referred to herein as (160). MEMS are Microelectromechanical Systems, sometimes written as micro-electro-mechanical, MicroElectroMechanical or microelectronic and microelectromechanical systems. MEMS are devices that include both electrical and mechanical elements. The elements are small and may be produced using processes and techniques from the semiconductor industry. Accordingly, many MEMS are produced on silicon, which also facilitates the incorporation of electronic components into the MEMS. The use of electronic components on the MEMS surface provides some advantages such as integrated design and shorter communications distances. However, this approach also produces a number of disadvantages, which may include: more complexity on the die, more surface area devoted to electronics that cannot be used for MEMS, greater material costs, greater production process complexity, reduced yields, and different electrical connection requirements.

Figure 5:
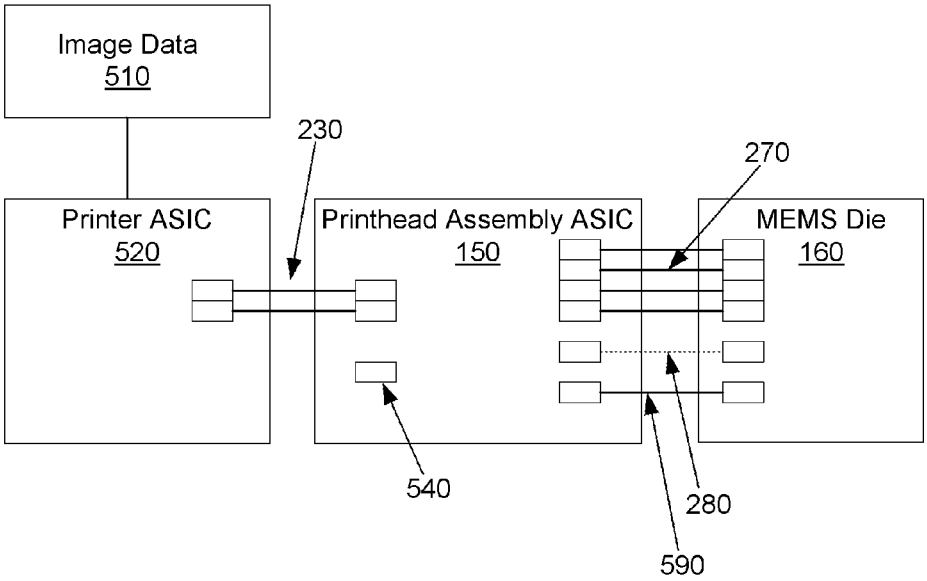
FIG. 5 is a diagram illustrating one configuration of a printhead and the associated communication lines according to the principles described herein.

Connecting the PHA ASIC (150) and the MEMS dice (160) are a number of electrical connections, not all of which are shown. These connections include a number of transmission lines (270) as well as a fire control line (280). In some examples, the lines run directly from the PHA ASIC (150) to the MEMS dice (160). In some examples, these lines run through the substrate (210). In some examples, these lines run through another MEMS die (160). In this example, allowing signals to be transmitted via another MEMS die (160) allows better coordination between the MEMS dice, and allows an identical design to work in different positions of the printhead assembly. For instance, an example is shown in connection with the upper bank of MEMS dice (160A-D) of FIG. 2 where the transmission lines (270) cascade from one die to the next allowing the information being passed to reach the correct MEMS die (160). Similarly, the propagation of the fire control line (280) in a similar manner may reduce the peak power demand from the bank of MEMS dice (160). In some examples, the electrical connections may further include a clock line (FIG. 5, 590).

The PHA ASIC (150) may represent a single element or a plurality of elements. The PHA ASIC (150) may perform a variety of functions. In some examples the PHA ASIC (150) prepares data for transmission to the MEMS dice (160). In some examples, the PHA ASIC (150) provides a fire control signal via the fire control line (280) to the MEMS dice (160).

The PHA ASIC (150) may be connected to an off- board communication link (230). The PHA ASIC (150) provides a clock signal (FIG. 5, 590) to the MEMS dice (160) as will be described in more detail below in connection with FIG. 5. Further, in some examples, the PHA ASIC (150) performs error correction using an error correction circuit (FIG. 5, 540) as will be described in more detail below in connection with FIG. 5.

Figure 3:
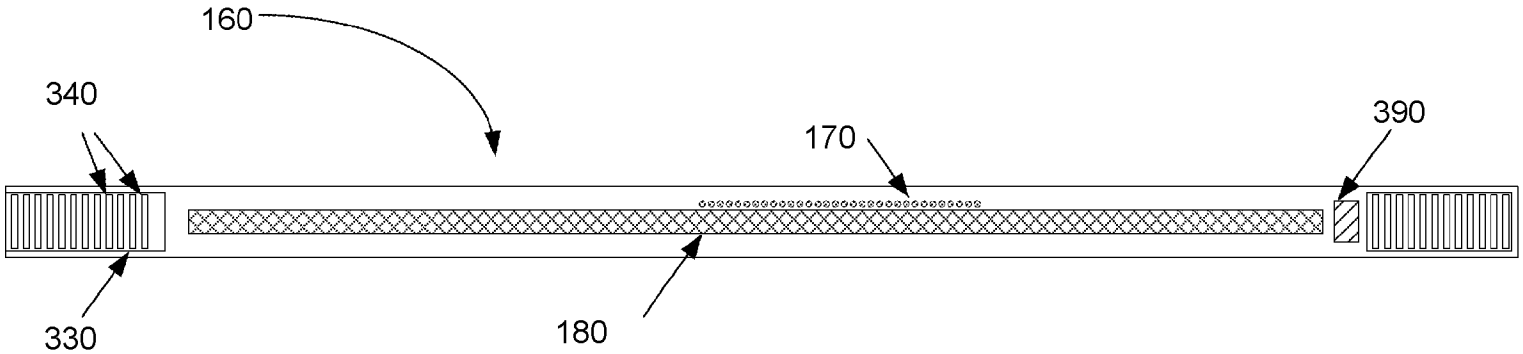
FIG. 3 is diagram of a MEMS die illustrating one example of the principles described herein.

FIG. 3 is diagram of a MEMS die (160) illustrating one example of the principles described herein. The MEMS die (160) includes a number of components including an opening (180), a number of jets (170), and a pad (330) that provides for a plurality of electrical connections (340). The electrical connections (340) facilitate communication between the components of the MEMS die (160) and the PHA ASIC (150). In some examples, a MEMS die (160) includes a thermal sensor (390). In some examples, a MEMS die (160) includes a heater. In some examples, heating is provided using a number of resistors located within each of a number of firing chambers of the MEMS die (160).

In one example, the thermal sensor (390) is controlled by the PHA ASIC (150). In another example, the thermal sensor (390) is controlled on the MEMS die (160). In some examples, the jets (170) form a column along the opening (180). In other examples, the jets (170) form columns on both sides of the opening (180). The MEMS die (160) may have a single pad (330) on one end of the MEMS die (160). In another example, the MEMS die (160) has pads (330) on both ends of the MEMS die (160). In still another example, the MEMS die (160) has a pad (330) located on the side and/or in the body of the MEMS die (160) to facilitate additional connections.

Figure 4:
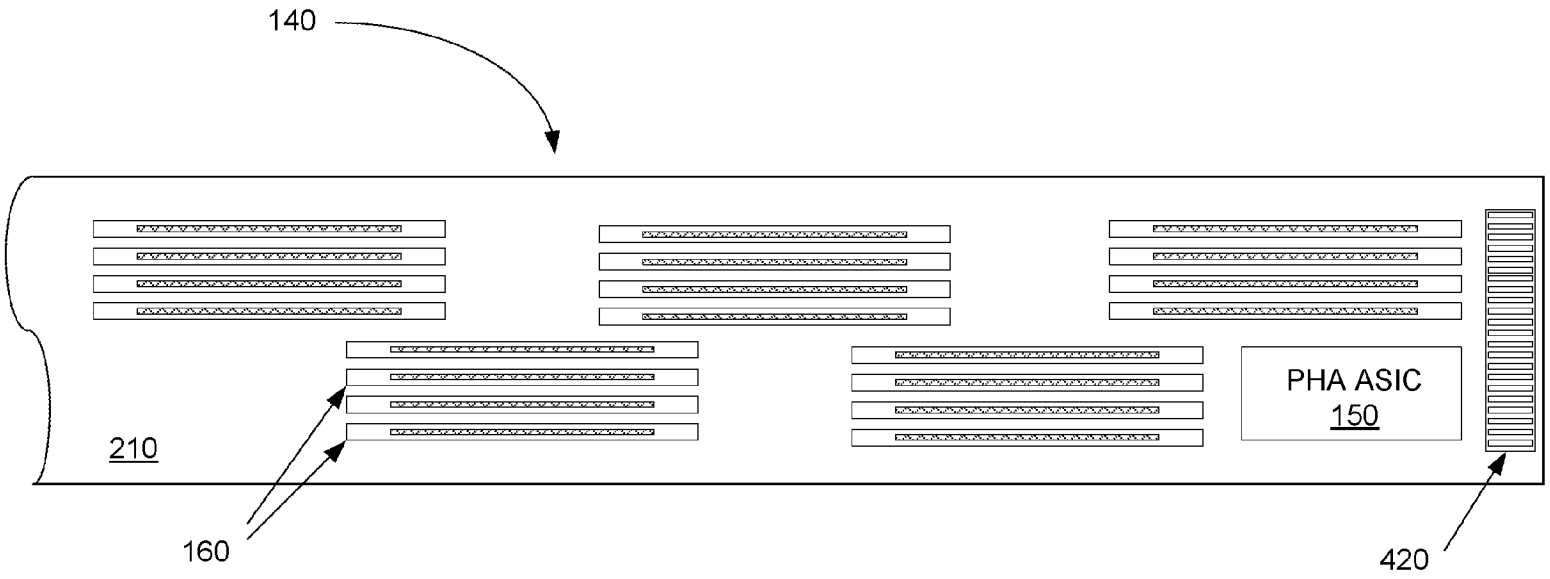
FIG. 4 is a diagram of a printhead showing multiple banks of MEMS die to illustrate one example of the principles herein.

The printhead (140) includes MEMS die (160) with groups of jets (170) associated with multiple parallel openings (180) allowing multiple components or colors of ink to be dispensed. FIG. 4 shows a printhead (140) with such a design. One approach to such a design is a printhead where the openings of the printhead are produced in a common substrate with some or all of the attendant controls integrated into the substrate. In this case, the yield may be dependent upon all the features of the design. Also, such designs use a larger footprint of silicon to produce. In another approach, each MEMS die (160) includes a single opening and the multiple MEMS dice (160) are assembled to form the printhead (140).

Silicon wafers are produced from silicon ingots, which tend to be of limited dimensions; often six or eight inches in diameter. Larger ingots and larger wafers are more expensive on a per area basis than smaller ingots and wafers, due in part to the increasing difficulty of producing larger, high purity silicon. Further, because few large dice may fit on a wafer, the cost for them is accordingly higher than for smaller dice that may make more efficient use of the area of the wafer. As a result, the cost of devices built on silicon substrates increase faster than the area of the devices, with larger MEMS die (160) costing disproportionately more than smaller MEMS die (160).

Further, increasing complexity and size may decrease the yield of a device. Consider a MEMS die (160) with a single opening and the attendant jets. Assume that this single opening die has a defect rate of X, where a defect is defined as something that would render the MEMS die unacceptable. If the die is expanded to include four parallel devices with no increase in complexity, the expected defect rate of the integrated four opening die may be approximated as roughly 4*X. It may be better approximated as $1-(1-X)^4$, but for small values of X the odds of multiple defects in a single MEMS is very low and may be roughly the square of the defect rates. When a four opening device has a defect in one opening, the entire device is deemed defective and is scrapped.

In contrast, if a group of four single opening devices has a defect in one of the devices, that one defective device is scrapped and the remaining three devices may be used. Assume that attaching a single opening device to the machine structure has a defect rate of Y. Attaching four such devices will have an overall defect rate of approximately 4*Y. In contrast, attaching a four opening device will have an attachment defect rate of approximately Y (for simplicity). If $Y<X$, then assembling the printhead from a number of single opening devices will produce better yields than an integrated, four opening design. Because of the non-linearity between costs and size, even if $Y>X$, there may be cases where it is cheaper to utilize single opening die.

The defect rate in a MEMS die (160) or integrated circuit device is dependent upon the complexity of the device. The same argument used with respect to the single opening assembly applies to other components of the MEMS. Accordingly, all other factors being equal, a simpler device is more likely to have better yields from a semiconductor or MEMS fabrication process. Accordingly, designs that may reduce the number of elements may increase yield. Generally, just moving the complexity from one part of design to another part of the design may not produce overall yield gains. However, moving complexity from high cost components to lower cost components may produce savings. Further, moving complexity from a component made by a process with a higher defect rate to a component made by a process with a lower defect rate may produce significant yield and cost savings.

Some designs are able to mitigate irregularities that would be defects in other designs. For instance, some circuit arrays are able to shut down portions with an irregularity and still allow the remainder of the device to be used. If additional capacity is built into the design, then the result is a part that, despite the irregularity, is not defective. Similarly, redundancy in the design may render the manufacturing irregularity irrelevant. If the redundancy is reasonably cheap, then this may be an effective strategy to mitigate scrap costs, especially in highly parallel devices. For instance, the PHA ASIC (150) functionality may be smaller and cheaper to produce than when integrated into individual MEMS die (160).

In light of the above, FIG. 4 shows a printhead (140) that includes multiple banks of MEMS die (160) illustrating one example of the principles herein. The printhead (140) includes a substrate (210) and a plurality of connections (420) to facilitate data and power transfer. In some examples, the printhead is covered with a polymer. The polymer insulates electrical contacts and prevents them from contacting the fluid or ink being used in the printhead (140). In FIG. 4, the MEMS dice (160) are organized into groups of four to facilitate full color printing using three colored inks and black ink. The groups are staggered so as to allow overlap between the columns of jets on the MEMS dice (160). The PHA ASIC (150) may be located on the device in a gap between the groups of MEMS dice (160).

In some examples, the MEMS dice (160) are interchangeable. The advantages of using a standardized design include: reduced number of parts, simpler assembly (less need to complicate the connections with different types of connections), increase manufacturing efficiencies, fewer part numbers, and lower inventory quantities and costs. In some examples, the MEMS die (160) used in a printhead include more than one design. For instance, the black ink die may have a higher or lower nozzle density than the color ink die or the color ink die may be a three opening die while the black ink die is a single opening die.

In another example, the high utilization portion of a page width printhead (140) along the left margin may have a different design to accommodate the different usage rate. In some examples, the MEMS die (160) are modular such that they may be placed in the same location but include different functionalities allowing multiple configurations of the printhead (140) to be built using some common components.

In another example, MEMS dice (160) with certain inks may be designed optimally using different layer thicknesses in certain processes in order to produce different geometries versus those used for other inks. For example with black and color ink, a larger drop weight black ink may have a larger height ejection chamber on its die while smaller drop weight colors may have a smaller height ejection chamber on their die. Even so, these color ink MEMS die (160) may be built identically on one die, using a thinner layer of polymer in the process for their die, as compared to black with higher drop weight. Each fluid or individual color of ink to be jetted may have its own optimized MEMS process if desired to optimally eject the fluid. In this way, each type of MEMS die (160) may be optimized to its ink to a degree that is not possible for designs that process all or most of the MEMS at one time on a single die.

In some examples, the printhead (140) is designed such that it may print an entire page width, eliminating the need for scanning the printhead (140) back and forth over the printed surface. Although the design of a page wide array printhead may result in a large number of MEMS die (160) to be incorporated into the printhead (140), the provision of the PHA ASIC on the printhead (140) may reduce the number of data channels between the printhead (140) and the printer (100). In some examples, the PHA ASIC (150) may consolidate operations that were previously performed on each of the multiple opening MEMS die (160). In some examples, the PHA ASIC (150) controls forty or more single opening MEMS die (160). In some examples, the PHA ASIC (150) provides control of the temperature regulation on the MEMS die (160).

The firing resistors located in the chambers of the jets on a thermal ink jet printhead may utilize higher voltage than the logic circuit used on the dice or on the printhead (140). In some examples, the PHA ASIC (150) provides staggered fire control signals to reduce the peak high voltage power draw from a single MEMS die (160). In some examples, the PHA ASIC (150) provides staggered fire control to reduce the peak high voltage power draw from the printhead (140) as a whole. This may reduce the costs of physical components in the printer (100) that would otherwise need to be able to provide larger currents. In some examples, this principal may be extended to portions of a jet (170) column supplied by a shared high voltage power line.

In some examples, the PHA ASIC (150) is a single device located as shown in FIG. 4. In another example, the PHA ASIC (150) is a number of devices mounted to the substrate (210) that control and coordinate operations of the MEMS die (160) on the printhead (140). In this example, these devices are located in the gaps between the groups of MEMS dice (160). In another example, the PHA ASIC (150) is a single device located near the center of the printhead. In some examples, the printhead (140) has additional memory or dedicated thermal controllers located on the printhead (140).

FIG. 5 is a diagram illustrating one configuration of the PHA ASIC (150) and the associated communication lines according to the principles described herein. In one example, image data (510) to be printed is provided to the printer ASIC (520). This may be accomplished in any number of ways. The printer ASIC (520) may store, batch, process, manipulate, or perform other handling of the image data (510). The printer ASIC may provide signals to different components of the printer (100) to prepare the printer (100) to print.

The printer ASIC (520) provides the original or a modified form of the image data (510) to the printhead assembly application specific integrated circuit (PHA ASIC) (150). This may be accomplished using a communications link (230). The communications link (230) may be optical, electrical, electromagnetic, or any suitable device and associated communications technologies used in data transfer. In some examples, the communications link (230) is a wireless local area network (WLAN) signal such as a Wi-Fi signal standard developed by the Wi-Fi Alliance, communication technologies developed by the BLUETOOTH® Special Interest Group, infrared signals, Radio Frequency signal, low-voltage differential signaling (LVDS), transition-minimized differential signaling (TMDS) , reduced swing differential signaling (RSDS), bus low voltage differential signaling (BLVDS), differential stub series terminated logic (SSTL), differential high speed transceiver logic (HSTL) and/or similar communications technologies and their respective communications devices. In one example, the communications link (230) includes a low-voltage differential signaling (LVDS) pair cable. In another example, the communications link (230) is a plurality of high speed data lines. In one example, the communication link (230) includes a discrete clock signal. In another example, the communication link (230) has an embedded clock signal that is extracted by the PHA ASIC (150).

In some examples, the PHA ASIC (150) operates on a clock that is faster than a clock provided to the MEMS die (160) via the clock line (590). For example, the PHA ASIC (150) may operate on a 140 MHz clock while providing a 10 MHz clock to the MEMS die (160). In another example, the PHA ASIC (150) may operate on a 200 MHz clock while providing a 20 MHz clock to the MEMS die (160). The operation of the PHA ASIC (150) on a faster clock than the MEMS die (160) has a number of advantages, including: reducing the number of data lines between the printer ASIC (520) and the PHA ASIC (230), accommodating error correction using an error correction circuit (540) in the communications link (530), and making the PHA ASIC (150) to MEMS DIE (160) communications less noise sensitive.

In some examples, the error correction performed by the error correction circuit (540) may include the inclusion of a parity bit or sum bit periodically in the communication link (230) between the printer ASIC (520) and PHA ASIC (150). In other examples, the error correction circuit (540) may include more sophisticated error correction methodologies including those error correction methodologies associated with controlling and verifying data compression and decompression.

After the PHA ASIC (150) has received the image data (510), it may further process the image data (510). In some examples, the firing patterns to produce the image are created by the PHA ASIC (150). In other examples, the firing patterns used to produce the image are created by the printer ASIC (520). In still other examples, the firing pattern is provided as part of the image data (510) or the image data (510) may be sent in a ready to print format. The PHA ASIC (150) may separate the image data (510) into signals provided to the individual MEMS die (160). These signals may be provided to the MEMS die (160) using the transmission lines (270). Because of the large numbers of jets (170) on a MEMS die (160), the data may be provided serially over the transmission lines (270).

This information may be loaded into the MEMS die (160) such that each jet (170) on the MEMS die (160) has a fire/don't fire bit provided to it. This bit may regulate the firing of the jets (170) on the MEMS die (160) upon receipt of the firing signal. In some examples, the bit is stored for a transistor associated with the firing resistor for the jet (170). If the transistor is open, then the receipt of the firing signal will not activate the firing resistor. If the transistor is closed, then receipt of the firing signal causes the firing resistor to heat up. The heat causes a portion of the fluid exposed to the resistor to vaporize, forming a bubble. This bubble expands, causing a droplet of ink to be expelled from the nozzle of the jet (170) toward the printing medium. The bubble then collapses, allowing more fluid into the jet (170) to prepare it for them next firing. In printing applications, the fluid may be ink, toner or some other marking fluid.

In some examples, the PHA ASIC (150) provides a clock signal by the clock line (590) to the MEMS dice (160). This is to facilitate and coordinate loading the serially provided fire/don't fire signals.

In some examples, the PHA ASIC (150) has a smaller minimum element size than that utilized by the MEMS die (160). Because the PHA ASIC (150) may function as a processor/controller, it may be fabricated using semiconductor fabrication techniques. These techniques have achieved large economies of scale and low defect rates, allowing higher speed devices to be built for lower cost and in smaller packages.

In contrast, the MEMS die may be manufactured with processes and techniques better designed to accommodate the mechanical elements of the MEMS die, especially the opening (180) and the jets (170). Because of the comparatively large size of the mechanical elements of the MEMS, use of slower processes with less fine control may be selected to economically produce the MEMS die (160). By moving the control portions from the MEMS die (160) to the PHA ASIC (150), the design may take advantage of using different processes to produce the PHA ASIC (150) and the MEMS die (160). In contrast, placing both the controls and the MEMS elements on the MEMS die (160) compromises the ability to get optimal design for either element. In some examples, more efficient designs may be created when the logic is relegated to a PHA ASIC (150) with smaller minimum feature sizes and the MEMS on the MEMS die (160) use fewer logics that may be readily produced with larger minimum feature size processes used to make the MEMS elements.

The fire control line (280) provides a signal to fire the jets (170). As discussed above, the jets (170) may be provided with a fire/don't fire bit that determines the pattern produced. The fire control line (280) assures that firing of the jets (170) doesn't occur until the proper pattern has been fully loaded. Although shown as a single line, the fire control line (280) may include a number of parallel lines that are fired in series. The signal may be subject to additional splitting or delay on the MEMS die (160). In one example, the fire control signal may be embedded in another signal.

Figure 6:
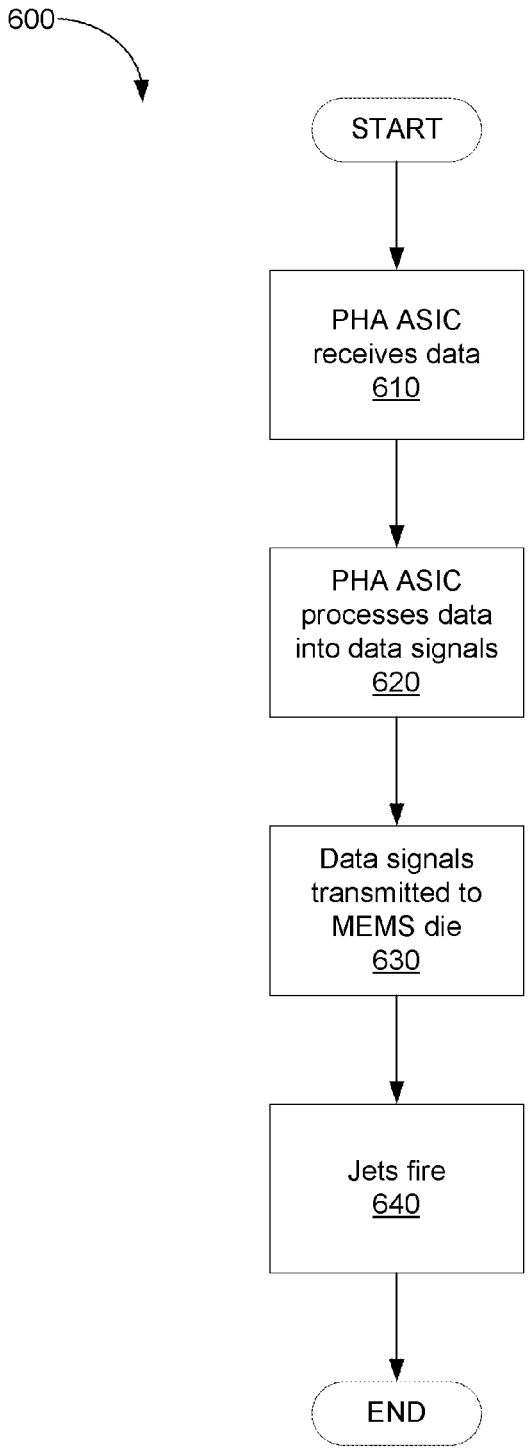
FIG. 6 is a flow chart of a process for printing according to the principles described herein.

FIG. 6 shows a flowchart for a process of printing (600) according to the principles described herein. This includes the processes of receiving (block 610) data to a printhead assembly (PHA) application specific integrated circuit (ASIC) (150); processing (block 620) the data into a plurality of data signals; transmitting (block 630) the data signals through a shared substrate (210) from the PHA ASIC (150) to a plurality of microelectromechanical systems (MEMS) dice (160); and firing (block 640) a plurality of ink jets (170) located on the MEMS dice (160).

At block 610, the PHA ASIC (150) receives data. This data may include a variety of information for printing an image. The data may be formatted for printing or the data may be subject to additional processing by the PHA ASIC (150).

At block 620, the PHA ASIC (150) processes the data into a plurality of data signals. In some examples this is a data signal for each active MEMS die (160) being used to print. As discussed above, in some examples the PHA ASIC uses a higher speed clock and provides a lower speed clock to the MEMS dice (160) which may reduce the number of communications lines into PHA ASIC (150). The signal received by the PHA ASIC is then divided to the MEMS dice (160) to regulate the firing of the jets (170). The processed data signals may be stored in a memory on the PHA ASIC (150) or may be provided to the MEMS dice (160) without being stored on the PHA ASIC (150).

At block 630, the PHA ASIC (150) transmits the data signals through a shared substrate to a plurality of microelectromechanical systems (MEMS) die. The shared substrate may provide a number of electrical connections between the MEMS dice (160) and the PHA ASIC (150) that may be used to send a variety of signals. For example data lines, clock lines, and/or fire control lines may be provided to each MEMS die and transmit signals extracted from the received data. In some examples, the received data includes a stand-alone clock signal. In other examples, the received data includes an embedded clock signal that is extracted by the PHA ASIC (150). In some examples, the same clock signal used by the PHA ASIC (150) and the MEMS dice (160), while in other examples the PHA ASIC (150) receives, extracts, and/or creates a slower clock signal that it provides to the MEMS dice (160). In some examples, there are other connections between the MEMS dice (160) and the PHA ASIC (150) used to transmit signals besides via the shared substrate. In one example, the shared substrate is a printed circuit board (PCB) and/or integrated circuit board. In another example, the shared substrate is a die.

At block 640, a plurality of inkjets (170) on the MEMS dice (160) are fired. In some examples a fire control signal is provided to the MEMS dice (160), to a single MEMS die (160), to a portion of a single MEMS die (160), or combinations thereof. The fire control signal may include a voltage profile and/or a current profile applied to a plurality of firing resistors in the jets (170). In other examples, the signal may be an on/off signal or may consist of a pulse length. In other examples, the fire control signal is directed to a piezoelectric element. Receipt of the fire control signal causes a plurality of the jets (170) to fire, expelling a portion of the fluid toward a printing surface. Selection of which jets (170) fire may be controlled in a number of ways. For example, the fire control signal may be directed at just those jets (170) that should fire. In another example, a fire/don't fire signal is loaded into an storage element, between the fire control line (280) and the jet (170) such that only those jets (170) with a fire signal loaded into the storage element receive the fire control signal. In another example, a suppression signal is provided to jets (170) that should not fire, which inactivates those jets (170).

The processes (610-640) described in this method (600) may be applied simultaneously and/or in any order. In some examples, the processes occur over a lengthy period of time to facilitate the printing of a large amount of material. In other examples, the processes occur over a short time frame and produce the deposition of a small amount of fluid, for instance when applying an active ingredient onto a substrate. Accordingly, the method described may be applied to a wide variety of conditions to produce a wide variety of useful results.

A printhead with a unified on board controller such as, for example, a PHA ASIC, may have a number of advantages, including: improved yields, reduced manufacturing cost, greater design flexibility, the ability to standardize die between a variety of printheads to achieve economies of scale, reduced connection costs, faster on board clock speed and data handling.

The preceding description has been presented to illustrate and describe examples of the principles described. This description is not intended to be exhaustive or to limit these principles to any precise form disclosed. Many modifications and variations are possible in light of the above teaching.

What is claimed is:

1. A print head assembly (PHA), comprising:
- a microelectromechanical systems (MEMS) die mounted to a substrate, the die comprising:
  - an opening defined in the die;
  - a plurality of nozzles adjacent to the opening in fluid communication with the opening; and
  - a pad to receive electrical control signals; and
- an application specific integrated circuit (ASIC) mounted to the substrate to processes image data received by the ASIC into electrical signals defining firing patterns, comprising:
  - a communication link; and
  - a plurality of transmission lines that transmit the electrical signals to the MEMS die.

2. The print head assembly of claim 1, further comprising a polymer coating.

3. The print head assembly of claim 1, wherein the MEMS die further comprises:
- a thermal sensor integrated into the MEMs die,
- wherein measurement circuitry for the thermal sensor is provided by the ASIC.

4. The print head assembly of claim 1, wherein the ASIC performs error correction.

5. The print head assembly of claim 1, wherein the communication link is wireless link.

6. The print head assembly of claim 1, wherein the data received through the communication link comprises a print job sent by a printer ASIC.

7. The print head assembly of claim 1, wherein the ASIC extracts a clock from a signal received through the communication link.

8. The print head assembly of claim 1, comprising a fire control line coupled between the ASIC and first one of the MEMS die, wherein a fire control signal is propagated through the MEMS die in a cascading manner.

9. A print head assembly (PHA), comprising:
- a plurality of modular, microelectromechanical systems (MEMS) dice mounted to a substrate, each MEMS die comprising:
  - an opening defined in the die;
  - a plurality of nozzles adjacent to the opening in fluid communication with the opening; and
  - a pad to receive electrical control signals; and
- an application specific integrated circuit (ASIC) mounted to the substrate, comprising:
  - processing architecture to process image data received by the ASIC into electrical signals defining firing patterns; and
  - a plurality of transmission lines that transmit the electrical signals to the MEMS dice.

10. The print head assembly of claim 9, wherein two or more of the MEMS dice are equivalent.

11. The print head assembly of claim 9, wherein the ASIC distributes the timing of the firing of the nozzles so as to limit peak demand for power within a MEMS die.

12. The print head assembly of claim 9, wherein the ASIC distributes the fire control signal to limit peak demand for power.

13. The print head assembly of claim 9, wherein a MEMS die receives signals from another MEMS die.

14. The print head assembly of claim 9, wherein the minimum feature size on a MEMS die is larger than the minimum feature size of the ASIC.

15. The print head assembly of claim 9, comprising a fire control line coupled between the ASIC and first one of the MEMS dice, wherein a fire control signal is propagated through the MEMS dice in a cascading manner.

16. The print head assembly of claim 9, wherein the ASIC mounted to the substrate communicates with a printing device ASIC included in a printing device associated with the print head assembly, and
- wherein the printing device ASIC provides original or modified forms of the image data to the ASIC mounted to the substrate.

17. A method of printing, comprising:
- receiving data to a printhead assembly (PHA) application specific integrated circuit (ASIC);
- processing, with the ASIC, the data into a plurality of data signals, the data signals defining firing patterns;

transmitting the data signals through a shared substrate from the PHA ASIC to a plurality of microelectromechanical systems (MEMS) dice; and firing a plurality of ink jets located on the MEMS dice in response to the data signals.

18. The method of claim 17, wherein the plurality of data signals includes a clock signal.

19. The method of claim 17, wherein firing the plurality of ink jets located on the MEMS dice in response to the data signals comprises, with the ASIC, distributing the timing of the firing of the ink jets so as to limit peak demand for power within a MEMS die.

* * * * *